United States Patent [19]

Nakakouji et al.

[11] Patent Number: 4,579,786

[45] Date of Patent: Apr. 1, 1986

[54] SURFACE-TREATED STEEL STRIPS SEAM WELDABLE INTO CANS

[75] Inventors: Hisatada Nakakouji; Hajime Ogata; Kyoko Yamaji; Kazuo Mochizuki; Toshio Ichida, all of Chiba, Japan

[73] Assignee: Kawasaki Steel Corporation, Kyogo, Japan

[21] Appl. No.: 718,340

[22] Filed: Apr. 1, 1985

[30] Foreign Application Priority Data

Mar. 31, 1984 [JP] Japan ..... 59-63883

[51] Int. Cl.[4] ..... C25D 5/10

[52] U.S. Cl. ..... 428/648; 428/629; 428/632; 428/646; 428/666; 428/667; 428/679; 428/680

[58] Field of Search ..... 428/648, 629, 632, 646, 428/666, 667, 679, 680

[56] References Cited

U.S. PATENT DOCUMENTS

| | | | |
|---|---|---|---|
| 4,442,181 | 4/1984 | Saito et al. | 428/648 |
| 4,468,292 | 8/1984 | Ban et al. | 428/648 |
| 4,501,802 | 2/1985 | Higuchi et al. | 428/648 |

FOREIGN PATENT DOCUMENTS

| | | | |
|---|---|---|---|
| 59-100285 | 9/1984 | Japan | 428/648 |

*Primary Examiner*—Veronica O'Keefe
*Attorney, Agent, or Firm*—Young & Thompson

[57] ABSTRACT

A surface-treated steel strip comprising a steel substrate, islands of metallic tin distributed on one major surface of the steel substrate, and a chromate coating deposited on the substrate major surface to cover the tin islands can be coated with lacquer, baked and then seam welded into food cans.

8 Claims, 8 Drawing Figures

10μ

SURFACE-TREATED STEEL STRIPS SEAM WELDABLE INTO CANS

BACKGROUND OF THE INVENTION

This invention relates to surface-treated steel strips or sheets from which seam-welded cans are produced, and more particularly, to surface-treated steel strips or sheets having such improved weldability as to permit can bodies to be joined into food cans by electric resistance seam welding.

Among food can-forming materials there have been most wedely used tin-coated steel strips generally called tin plates. In order to join the mating edges of a can body, conventional soldering techniques were previously used. Because of the toxicity of lead contained in conventional solder, pure tin solder has recently become prevalent. The pure tin solder, however, has a technical problem in making a joint because of inferior wetability during the soldering process and is so expensive as to create the economic problem of increased manufacture cost.

On the other hand, in recent years, food containers have enjoyed the development of inexpensive, competitive materials such as polyethylene, aluminum, glass, processed paper and the like. Despite their significantly improved corrosion resistance among other advantages, tin plate cans having expensive tin thickly coated thereon to a coating weight of as great as 2.8 to 11.2 $g/m^2$ require a relatively high cost of manufacture and have encounterd severe competition.

In order to overcome the above-described drawbacks of tinplate cans, electric resistance welding of can bodies has recently replaced the conventional soldering technique and become widespread. There is the need for can-forming steel compatible with electric resistance welding.

In addition to tinplate discussed above, tin-free steel of chromium type is another typical example of conventional can-forming steel. The tin-free steel is prepared by carrying out an electrolytic chromate treatment on steel to form a layer of metallic chromium and hydrated chromium oxides on the surface. Since the relatively thick hydrated chromium oxide film on the surface has a relatively high electric resistance, the chromated steel is ineffectively welded to form a weld of insufficient strength and thus unsuitable as welded can-forming steel despite its economic advantage.

Since other can-forming materials are also inadequate as welded can-forming material, a variety of proposals have been made. One example is nickel-plated steel, typically "Nickel-Lite" announced by National Steel Corporation of the U.S. which is prepared by plating a steel strip with nickel to a thickness of about 0.5 $g/m^2$ followed by a conventional chromate treatment. Inferior adhesion of lacquer and inferior weldability in high speed welding at 30 m/min. or higher have limited the spread of this nickel-plated steel.

Another example is "Tin Alloy" announced by Jones & Laughlin Steel Corporation of the U.S. This is prepared by thinly coating a steel strip with tin to a thickness of about 0.6 $g/m^2$ and effecting tin reflow or flow melting followed by a conventional chromate treatment. Unfortunately, rust resistance, lacquer adhesion and weldability are insufficient.

In general, can-forming steel sheets intended for electric resistance welding are required to exhibit improved weldability and corrosion resistance after lacquering.

These requirements will be explained in detail. There must be an optimum welding electric current range within which a weld zone having sufficient weld strength is provided at the end of welding without any weld defects such as so-called "splashes". Since welded cans are filled with foodstuffs after lacquer coating, the underlying steel must have sufficient adhesion to lacquer to take full advantage of the corrosion prevention of the lacquer film. Furthermore, despite defects unavoidably occurring in a lacquer film, the improved corrosion resistance of the underlying steel itself must prevent corrosion from proceeding.

SUMMARY OF THE INVENTION

It is, therefore, an object of the present invention to provide a novel and improved surface-treated steel strip which can be seam welded into cans without the above-mentioned drawbacks and has improved weldability, corrosion resistance after lacquering, and lacquer adhesion.

According to the present invention, there is provided a surface-treated steel strip seam weldable into cans, comprising a steel substrate, a plurality of islands of metallic tin distributed on one major surface of the steel substrate, and a chromate coating deposited on the substrate major surface to cover the tin islands and consisting essentially of hydrated chromium oxides or metallic chromium and hydrated chromium oxides.

In the preferred embodiment of the present invention, each of the tin islands has a surface area of 1 to 800,000 $\mu m^2$ and a thickness of 0.007 to 0.70 $\mu m$ and the tin islands occupy 20 to 80% of the area of the substrate major surface. The chromate coating contains chromium in a total amount of not more than 30 $mg/m^2$ and the amount of hydrated chromium oxide present ranges from 3 to 25 $mg/m^2$ of elemental chromium.

By the term "islands" used herein is meant that metallic tin is deposited on the steel surface in an island pattern, including that (1) islands of tin are distributed on the steel surface whereupon some islands may be discrete and some may be interconnected, and (2) a layer of tin has an irregular surface or local mesa or protrusions are distributed over a very thin base layer. In the latter case, the local protrusions are the islands as defined herein. Differently stated, the very thin base layer of tin can be neglected because of its thinness (less than 0.007 $\mu m$) except for the determination of the thickness of the local protrusions or islands. The very thin base layer of tin need not be continuous.

BRIEF DESCRIPTION OF THE DRAWINGS

These and other objects, features, and advantages of the present invention will become apparent from the following description taken in conjunction with the accompanying drawings, in which.

DETAILED DESCRIPTION OF THE INVENTION

Figure 1A:
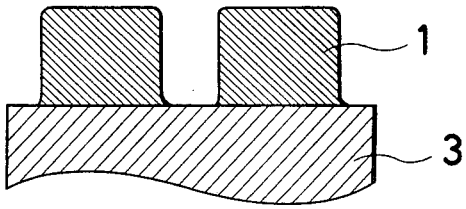
FIGS. 1*a* to 1*c* are cross-sectional views of a steel substrate having tin islands formed by different processes.

Making a number of experiments to examine the weldability of surface-treated steel strips destined to be seam welded into cans, we have found that metallic tin contributes to an improvement in weldability, particularly in high speed welding at 40 to 60 m/min. commonly employed in commercial can manufacture.

More illustratively, metallic tin which is deposited on a steel substrate according to the present invention is a soft metal. When contacted with a welding electrode or with the steel strip itself, the metallic tin is readily deformed to expand the area of contact, thereby reducing the local concentration of welding current at the initial of welding process. Because of its melting point as low as 232° C., the metallic tin is readily melted upon welding to further expand the contact area and to facilitate mutual joint of metals by fusion. These prevent the probable occurrence of "splashes" due to local welding current concentration and facilitate formation of a rigid welding nugget, eventually extending the optimum welding current range.

This effect of metallic tin becomes more significant in high speed welding at speeds of 40 to 60 m/min. where high current is conducted for 1 to 1.5 msec. to form one nugget.

It is due to the presence of about 2.2 g/m$^2$ of metallic tin that #25 tinplate has a wide optimum welding current range.

Further examining the relationship of weldability and metallic tin, we have found that independent of the type of substrate metal, the presence of at least 0.007 μm thick metallic tin on the surface permits high speed welding to be conducted at 40 to 60 m/min. and in the optimum welding current range which is sufficiently wide in commercial applications. That is, the provision of at least 0.007 μm thick metallic tin on the surface ensures improved weldability.

Seam welded cans are generally formed by coating a steel sheet with lacquer on the inside or both sides thereof before it is seam welded. The coating step is often followed by lacquer baking which causes the metallic tin to alloy with the substrate metal prior to the welding step. The exact amount of metallic tin available in welding is thus reduced. This means that the amount of metallic tin initially deposited must be in excess of the amount required to ensure sound welding. The loss of metallic tin due to alloying during lacquer baking is inconstant and depends on the type of substrate metal, baking temperature, baking time, and the number of lacquer baking steps. For instance, baking at 210° C. for 20 minutes results in a loss of metallic tin of about 0.07 μm in thickness provided that the substrate metal is conventional steel commonly used for tinplate manufacture. The loss of metallic tin is about 0.10 μm in thickness when the substrate is a conventional tinplate-forming steel strip plated with Ni to 100 mg/m$^2$ (the technique of plating steel with an undercoat has been attempted to improve corrosion resistance).

Inconveniently, the initial amount of metallic tin deposited must be larger than the effective minimum amount of metallic tin to improve weldability by a factor of several or ten or more depending on the substrate metal type and baking conditions, unnecessarily increasing the cost.

To overcome this problem, we have examined the state of metallic tin on steel surface to find that by converting the metallic tin layer into an island pattern or a layer having a plurality of islands or protruding portions, the amount of metallic tin required can be saved to a substantial extent without sacrifying weldability. This benefit attributable to the distribution of metallic tin in a plural island pattern is also obtained even through the use of a room temperature curable lacquer which requires no baking after coating.

Metallic tin is effective in improving weldability, but formation of tin oxide on the metallic tin surface detracts from adhesion of lacquer thereto. However, lacquer adhesion and corrosion resistance can be improved by forming a chromate coating on the surface, the chromate coating consisting essentially of hydrated chromium oxides or metallic chromium and hydrated chromium oxides. Particularly chromate coatings consisting essentially of metallic chromium and hydrated chromium oxides are most effective in improving lacquer adhesion and corrosion resistance after lacquering so that the products are highly resistant to the attack by corrosive can contents.

Hydrated chromium oxide is a high resistivity material. Metallic chromium will be converted into high resistivity oxide at elevated temperatures encountered upon welding. The content of metallic chromium in the chromate coating must be kept below a certain level.

The present invention will be illustrated in further detail.

Metallic tin is deposited according to the present invention for the purpose of improving weldability. Metallic tin is distributed in an island pattern including partially discrete and partially interconnected islands and a very thin layer having local protruding portions or islands. In the preferred embodiment of the present invention, (i) each tin island has a surface area of 1 μm$^2$ to 800,000 μm$^2$ (ii) each tin island has a thickness of 0.007 μm to 0.70 μm and (iii) the tin islands occupy 20% to 80% of the area of the substrate major surface.

The surface area of each tin island is limited to the range from 1 μm$^2$ to 800,000 μm$^2$ because islands of less than 1 μm$^2$ are insufficient to expand the contact area upon welding and thus contribute to no substantial improvement in weldability. The contact area expanding effect is saturated at surface areas of approximately 800,000 μm$^2$ and thus, surface areas beyond 800,000 μm$^2$ uneconomically consume tin beyond the requisite level.

The space factor of islands is limited to the range from 20% to 80% because space factors below 20% are insufficient to expand the contact area upon welding and thus contribute to no substantial improvement in weldability. Space factors beyond 80% apparently detract from the economic benefit due to island patterning.

Further, the thickness of metallic tin islands is limited to the range from 0.007 μm to 0.70 μm. Tin islands thinner than 0.007 μm fail to improve weldability to a substantial extent whereas thicknesses beyond 0.70 μm lead to an economic disadvantage because the weldability improving effect is saturated thereat. The exact thickness of metallic tin islands may be selected within the above-specified range depending on the type of substrate metal and lacquer baking conditions. When the lacquer subsequently applied is to be baked, the (initial) thickness of metallic tin islands is such that the corresponding islands remaining after lacquer baking have a thickness of at least 0.007 μm.

Metallic tin may be distributed in an island pattern by a variety of processes. Some typical processes are described below.

(1) Electroplating via mask

Tin is electrodeposited onto a metal substrate through a masking sheet having a plurality of micropores of any desired configuration to form a corresponding plurality of tin islands. FIG. 1*a* illustrates a steel substrate 3 having a plurality of discrete tin islands 3 on the surface thereof.

(2) Agglomeration using flux

Figure 1B:
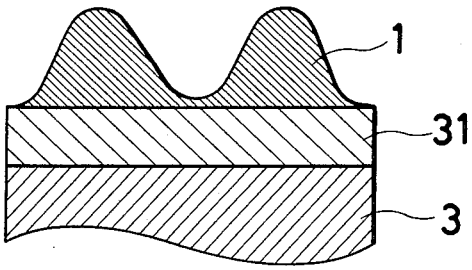

Tin is once electrodeposited onto a metal substrate to form an even tin layer, a flux (for example, aqueous solutions of $ZnCl_2$, $NH_4Cl$, and similar salts) is applied to the surface of the tin layer in any desired distribution pattern, and tin reflow is then carried out, thereby causing tin to locally agglomerate and coagulate into islands by taking advantage of the differential wetability of molten tin between fluxed areas and flux-free areas. FIG. 1*b* illustrates a steel substrate 3 having tin islands 1 thereon. An Fe—Sn alloy layer 31 is formed between steel 3 and islands 1 by flow melting.

(3) Agglomeration on inactive surface

The surface of the metal substrate is rendered inactive to wetting by molten tin, for example, by nickel diffusion, tin is evenly electrodeposited onto the inactivated surface, and tin reflow is then carried out, thereby causing tin to locally agglomerate and coagulate into islands.

Figure 1C:
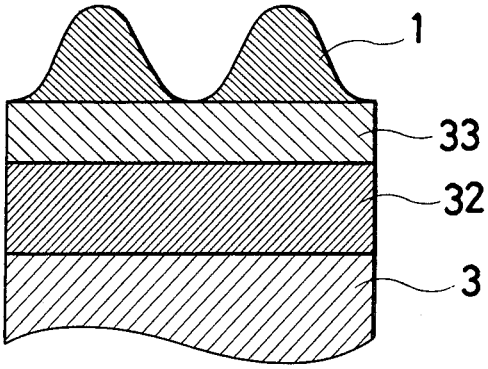

FIG. 1*c* illustrates a steel substrate 3 having tin islands 1 thereon. The steel substrate 3 includes an inactivated layer 32 at the surface. An Fe—Ni—Sn alloy layer 33 is formed between the surface of inactivated layer 32 and tin islands 1 by flow melting.

Preferably, nickel is diffused into the steel substrate to form nickel diffused layer 32 having a weight ratio of Ni/(Ni+Fe) of 0.50 or less and a thickness of 5000 Å or less. The nickel diffused layer is formed as the inactivated layer which helps an even tin layer be processed into islands or a thin layer having local protrusions.

As apparent from these figures, methods (2) and (3) tend to allow a very thin layer of tin to remain on substrate surface portions which are otherwise exposed. It should be understood that the method for manufacturing surface-treated steel strips according to the present invention is not limited to these processes.

Referring to FIG. 2, there is schematically illustrated the saving of metallic tin amount due to the distribution of metallic tin in islands. FIG. 2*a* is a cross-sectional view of a prior art steel strip comprising a steel substrate 3, an even tin layer 1 coextensive with the substrate surface, and a chromate coating 4 on the tin layer. FIG. 2*b* is a cross-sectional view of the same steel strip as in FIG. 2*a* after it is heat treated at 210° C. for 20 minutes, which heat treatment corresponds to the standard baking in actual lacquer coating process. The heat treatment forms an alloy layer 2 between the substrate 3 and the tin layer 1 which is reduced in thickness.

Figure 2A:
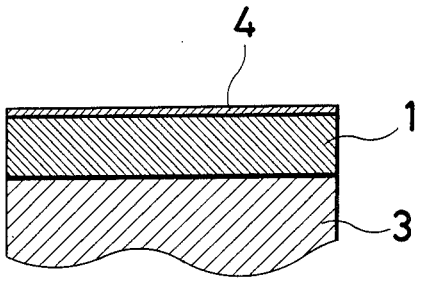
FIG. 2a PRIOR ART
FIG. 2*a* is a cross-sectional view of a steel strip having an even layer of metallic tin according to a prior art.
Figure 2B:
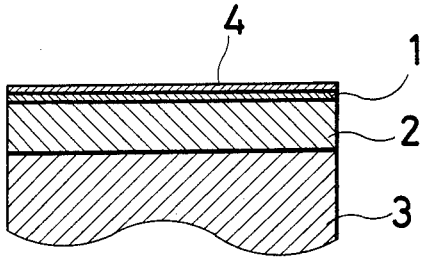
FIG. 2b PRIOR ART
FIG. 2*b* is a cross-sectional view of the steel strip of FIG. 2*a* after it is heat treated at 210° C. for 20 minutes.
Figure 2C:
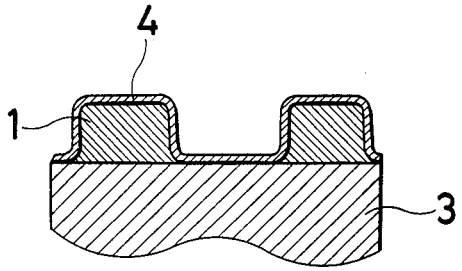
FIG. 2*c* is a cross-sectional view of a steel strip having islands of metallic tin according to the present invention.
Figure 2D:
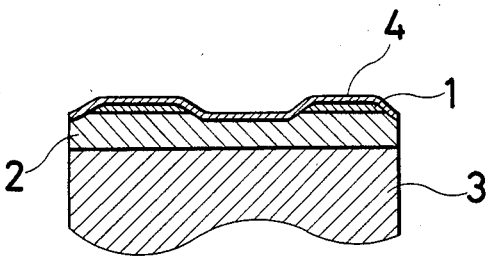
FIG. 2*d* is a cross-sectional view of the steel strip of FIG. 2*c* after it is heat treated at 210° C. for 20 minutes.

FIG. 2*c* illustrates a steel strip comprising a steel substrate 3, a plurality of islands 1 of metallic tin distributed on one major surface of the steel substrate and defining a valley therebetween, and a chromate coating 4 deposited on the substrate major surface to cover the tin islands 1. FIG. 2*d* is a cross-sectional view of the same steel strip as in FIG. 2*c* after it is heat treated at 210° C. for 20 minutes. Also, the heat treatment forms an alloy layer 2 between the substrate 3 and the tin islands 1 which are reduced in thickness.

As seen from the figures, the amount of metallic tin deposited in FIG. 2*c* is one half of that in FIG. 2*a*. The thickness of metallic tin 1 remaining after the heat treatment at 210° C. for 20 minutes as shown in FIG. 2*d* is approximately equal to that in FIG. 2*b* and thus just requisite for welding. The difference in the amount of metallic tin deposited between FIGS. 2*a* and 2*c* is a saving.

Figure 3:
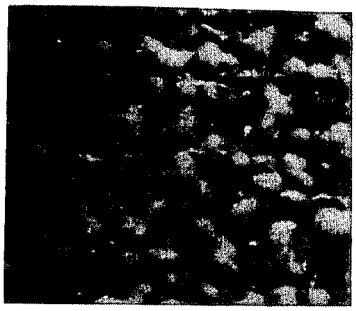
FIG. 3 is a photomicrograph illustrating the distribution of metallic tin islands on a steel substrate under a scanning electron microscope.

FIG. 3 is a photomicrograph showing the distribution of metallic tin islands deposited according to the present invention. It is evident that some tin islands are discrete and some are interconnected.

The chromate coating is provided in the present invention to cover the tin islands and the exposed substrate surface for the purpose of improving lacquer adhesion and corrosion resistance. The chromate coating consists essentially of hydrated chromium oxides or metallic chromium and hydrated chromium oxides. Preferably, the chromate coating contains chromium in a total amount of not more than 30 $mg/m^2$, and the amount of hydrated chromium oxides ranges from 3 $mg/m^2$ to 25 $mg/m^2$ expressed as elemental chromium.

Chromate coatings containing more than 30 $mg/m^2$ of chromium in total impair weldability to prevent setting of any optimum welding current range. Chromate coatings containing less than 3 $mg/m^2$ of hydrated chromium oxide (expressed as elemental chromium) will not fully improve lacquer adhesion, resulting in substantially deteriorated corrosion resistance after lacquering. Since hydrated chromium oxide is a high resistivity material, contents of hydrated chromium oxide in excess of 25 $mg/m^2$ substantially impair weldability without regard to the content of metallic chromium.

The chromate coatings consisting essentially of hydrated chromium oxides may be formed from aqueous solutions of anhydrous chromic acid, chromates, and dichromates and mixtures thereof by any desired techniques including dipping, spraying, and cathodic electrolysis.

The chromate coatings consisting essentially of metallic chromium and hydrated chromium oxides may be formed from similar solutions containing an adequate amount of anions like sulfate and fluoride ions by cathodic electrolysis. The content of metallic chromium deposited may be controlled by a proper choice of cathodic electrolysis conditions including current density, bath temperature, and bath composition.

Examples of the present invention are presented below by way of illustration and not by way of limitation. Comparative Examples are also presented to demonstrate the benefits of the present invention.

EXAMPLE 1

A conventional steel strip from a lot usually employed for the production of tinplate was electrolytically degreased and pickled. A masking sheet having pores of 3 μm in diameter was placed on the steel strip. Using a halogen electrolyte bath, metallic tin was electroplated on the steel in island pattern. The metallic tin islands each having an average surface area of 9 $\mu m^2$ and a thickness of 0.11 μm occupied 55% of the surface area of the underlying steel (i.e., space factor 55%).

The tinned strip was subjected to cathodic electrolysis in an aqueous chromate bath containing 15 g/l of $CrO_3$ and 0.13 g/l of $H_2SO_4$ at a temperature of 40° C. and a current density of 10 A/dm$^2$, forming on the tinned strip a chromate coating consisting essentially of 5 mg/m$^2$ of metallic chromium and 10 mg/m$^2$ of hydrated chromium oxides as expressed in elemental chromium.

That surface of the thus treated strip which corresponds to the inner surface of a can prepared therefrom was coated with an epoxy-phenol lacquer in a weight of 60 mg/m$^2$ followed by baking at 210° C. for 10 minutes. The opposite surface of the strip which corresponds to the can outer surface was then coated with the same epoxy-phenol lacquer in a weight of 60 mg/m$^2$ followed by baking at 210° C. for 10 minutes. The strip was rounded into a cylindrical form and welded along the overlapping portion at a welding speed of 55 m/min. to find that the optimum welding current range was 400 amperes.

Cans were prepared from the strip in a conventional manner, filled with coffee and orange juice, sealed in a conventional manner, and stored at 38° C. for 6 months. After storage, the cans were opened and observed on the inner surface to find that neither lacquer coating separation nor blister occurred while the flavor of the contents was not impaired.

COMPARATIVE EXAMPLE 1

The procedure of Example 1 was repeated except that metallic tin was electroplated on a steel strip via a masking sheet having pores of 4 μm in diameter to form metallic tin islands which had an average surface area of 15 μm$^2$, a thickness of 0.005 μm, and a space factor of 62%. This tinned strip was coated with a chromate film and then coated with a lacquer followed by baking in the same manner as in Example 1. The thus obtained strip was welded as a welding speed of 55 m/min. No optimum welding current range was found due to the lack of the sufficient tin thickness.

COMPARATIVE EXAMPLE 2

The procedure of Example 1 was repeated except that metallic tin was electroplated on a steel strip via a masking sheet having pores of 1 μm in diameter to form metallic tin islands which had an average surface area of 0.8 μm$^2$, a thickness of 0.15 μm, and a space factor of 37%. This tinned strip was coated with a chromate film and then coated with a lacquer followed by baking in the same manner as in Example 1. The thus obtained strip was welded as a welding speed of 55 m/min. No optimum welding current range was found due to the lack of the sufficient tin island surface area.

COMPARATIVE EXAMPLE 3

The procedure of Example 1 was repeated except that metallic tin was electroplated on a steel strip via a masking sheet having pores of 100 μm in diameter to form metallic tin islands which had an average surface area of 10,000 μm$^2$, a thickness of 0.20 μm, and a space factor of 15%. This tinned strip was coated with a chromate film and then coated with a lacquer followed by baking in the same manner as in Example 1. The thus obtained strip was welded as a welding speed of 55 m/min. No optimum welding current range was found due to the lack of the sufficient tin island space factor.

EXAMPLE 2

A conventional steel strip from a lot usually employed for the production of tinplate was electrolytically degreased and pickled. A masking sheet having pores of 200 μm in diameter was placed on the steel strip. Using a stannous sulphate electrolyte bath, metallic tin was electroplated on the steel in island pattern. The metallic tin islands each having an average surface area of 31,500 μm$^2$ and a thickness of 0.15 μm occupied 70% of the surface area of the underlying steel (i.e., space factor 70%).

The tinned strip was subjected to cathodic electrolysis in a chromate bath containing 50 g/l at pH 3.0 at a temperature of 50° C. and a current density of 10 A/dm$^2$, forming on the tinned strip a chromate coating consisting essentially of 18 mg/m$^2$ of hydrated chromium oxides as expressed in elemental chromium.

The thus treated strip was coated with a lacquer followed by baking in the same manner as in Example 1. The strip was rounded into a cylindrical form and welded along the overlapping portion at a welding speed of 55 m/min. to find that the optimum welding current range was 380 amperes.

Cans were prepared from the strip in a conventional manner, filled with coffee and orange juice, sealed in a conventional manner, and stored at 38° C. for 6 months. After storage, the cans were opened and observed on the inner surface to find that neither lacquer coating separation nor blister occurred while the flavor of the contents was not impaired.

COMPARATIVE EXAMPLE 4

Islands of tin were electroplated on a steel strip by the same procedure as Example 2. The tinned strip was immersed in a chromate bath containing 30 g/l of sodium dichromate at pH 4.5, forming a chromate coating consisting essentially of 2 mg/m$^2$ of hydrated chromium oxides as expressed in elemental chromium. The resulting strip was lacquer coated and baked in the same manner as in Example 1. The strip was rounded into a cylindrical form and welded along the overlapping portion at a welding speed of 55 m/min. to find that the optimum welding current range was 480 amperes.

Cans were prepared from the strip in a conventional manner, filled with coffee and orange juice, sealed in a conventional manner, and stored at 38° C. for 6 months. After storage, the cans were opened and observed on the inner surface to find that blisters occurred at the head space portion.

COMPARATIVE EXAMPLE 5

Islands of tin were electroplated on a steel strip by the same procedure as Example 2. The tinned strip was subjected to cathodic electrolysis in a chromate bath containing 30 g/l of $CrO_3$ and 0.25 g/l of $H_2SO_4$ temperature of 50° C. and a current density of 15 A/dm$^2$, forming a chromate coating consisting essentially of 8 mg/m$^2$ of metallic chromium and 27 mg/m$^2$ of hydrated chromium oxides as expressed in elemental chromium.

The resulting strip was lacquer coated and baked in the same manner as in Example 1. The strip was rounded into a cylindrical form and welded along the overlapping portion at a welding speed of 55 m/min. to find no optimum welding current range.

EXAMPLE 3

A conventional tinplate-forming steel strip was cold rolled, electrolytically degreased, plated with nickel in a weight per unit area of 0.07 g/m$^2$ on each surface, and then heat treated in a non-oxidizing atmosphere to form a nickel diffused layer having a weight ratio of Ni/(Ni+Fe) of 0.20 and a thickness of 2000 Å as the inactivated layer. The strip was then skin pass rolled at a reduction of 1.5%, electrolytically degreased, and pickled. Tin was electrodeposited in a weight per unit area of 0.8 g/m$^2$ on each surface of the strip from a halide bath. The tinned strip was heated to effect tin flow melting and then quenched in water, causing tin to agglomerate and coagulate. The thus formed tin islands or protrusions had a surface area of 25 $\mu m^2$, a thickness of 0.30 $\mu$m, and a space factor of 50%. An Fe—Ni—Sn alloy layer was formed between the tin layer having protrusions and the nickel diffused layer.

The tinned strip was subjected to cathodic electrolysis in an aqueous chromate bath containing 20 g/l of $CrO_3$ and 0.16 g/l of $H_2SO_4$ at a temperature of 40° C. and density of 15 A/dm$^2$, forming on the tinned strip a chromate coating consisting essentially of 6 mg/m$^2$ of metallic chromium and 9 mg/m$^2$ of hydrated chromium oxides as expressed in elemental chromium.

The thus treated strip was coated with a lacquer followed by baking in the same manner as in Example 1. The strip was rounded into a cylindrical form and welded along the overlapping portion at a welding speed of 55 m/min. to find that the optimum welding current range was 600 amperes.

Cans were prepared from the strip in a conventional manner, filled with coffee and orange juice, sealed in a conventional manner, and stored at 38° C. for 6 months. After storage, the cans were opened and observed on the inner surface to find that neither lacquer coating separation nor blister occurred while the flavor of the contents was not impaired.

EXAMPLE 4

A conventional tinplate-forming steel strip was electrolytically degreased, pickled, and plated with chromium in an aqueous chromate bath containing 250 g/l of $CrO_3$ and 2.5 g/l of $H_2SO_4$ at a temperature of 50° C. and a current density of 50 A/dm$^2$ to form a chromium plating having a weight per unit are of 15 mg/m$^2$ on each surface as the inactivated layer. Tin was then electrodeposited in a weight per unit area of 0.8 g/m$^2$ on each surface of the strip from an alkali bath. The tinned strip was heated to effect tin flow melting and then quenched in water, causing tin to agglomerate and coagulate into islands. The thus formed tin islands or protrusions had a surface area of 100 $\mu m^2$, a thickness of 0.40 $\mu$m, and a space factor of 30%.

The tinned strip was subjected to cathodic electrolysis in an aqueous chromate bath containing 15 g/l of $CrO_3$ and 0.12 g/l of $H_2SO_4$ at a temperature of 45° C. and a current density of 10 A/dm$^2$, forming on the tinned strip a chromate coating consisting essentially of 3 mg/m$^2$ of metallic chromium and 5 mg/m$^2$ of hydrated chromium oxides as expressed in elemental chromium.

The thus treated strip was coated with a lacquer followed by baking in the same manner as in Example 1. The strip was rounded into a cylindrical form and welded along the overlapping portion at a welding speed of 55 m/min. to find that the optimum welding current range was 350 amperes.

Cans were prepared from the strip in a conventional manner, filled with coffee and orange juice, sealed in a conventional manner, and stored at 38° C. for 6 months. After storage, the cans were opened and observed on the inner surface to find that neither lacquer coating separation nor blister occurred while the flavor of the contents was not impaired.

COMPARATIVE EXAMPLE 6

The procedure of Example 3 was repeated except that a chromate coating was formed after the inactivation and tin plating without intervening tin flow melting.

The thus treated strip was coated with a lacquer followed by baking in the same manner as in Example 1. The strip was rounded into a cylindrical form and welded along the overlapping portion at a welding speed of 55 m/min. to find that there was no optimum welding current range because the metallic tin layer was even, that is, it was not processed into islands.

We claim:

1. A surface-treated steel strip seam weldable into cans, comprising a steel substrate, a plurality of islands of metallic tin distributed on one major surface of the steel substrate, and a chromate coating deposited on the substrate major surface to cover the tin islands and consisting essentially of hydrated chromium oxides or metallic chromium and hydrated chromium oxides.

2. A surface-treated steel strip seam weldable into cans according to claim 1 wherein each of the tin islands has a surface area of 1 to 800,000 $\mu m^2$ and a thickness of 0.007 to 0.70 $\mu$m and the tin islands occupy 20 to 80% of the area of the substrate major surface.

3. A surface-treated steel strip seam weldable into cans according to claim 1 wherein the chromate coating contains hydrated chromium oxides in an amount of from 3 to 25 mg/m$^2$ of elemental chromium.

4. A surface-treated steel strip seam weldable into cans according to claim 1 wherein the chromate coating contains chromium in a total amount of not more than 30 mg/m$^2$ and the amount of hydrated chromium oxides ranges from 3 to 25 mg/m$^2$ as expressed in elemental chromium.

5. A surface-treated steel strip seam weldable into cans, comprising a steel substrate, a nickel diffused layer formed as an inactivated layer in one major surface of the steel substrate and having a weight ratio of Ni/(Ni+Fe) of 0.50 or less and a thickness of 5000 Å or less, and an Fe—Ni—Sn alloy layer on the nickel diffused layer, a plurality of islands of metallic tin distributed on one major surface of the steel substrate, said Fe—Ni—Sn alloy layer being formed between the nickel diffused layer and the tin islands, and a chromate coating deposited on the substrate major surface to cover the tin islands and consisting essentially of hydrated chromium oxides or metallic chromium and hydrated chromium oxides.

6. A surface-treated steel strip seam weldable into cans according to claim 5 wherein each of the tin islands has a surface area of 1 to 800,000 $\mu m^2$ and a thickness of 0.007 to 0.70 $\mu m$ and the tin islands occupy 20 to 80% of the area of the substrate major surface.

7. A surface-treated steel strip seam weldable into cans according to claim 5 wherein the chromate coating contains hydrated chromium oxides in an amount of from 3 to 25 $mg/m^2$ of elemental chromium.

8. A surface-treated steel strip seam weldable into cans according to claim 5 wherein the chromate coating contains chromium in a total amount of not more than 30 $mg/m^2$ and the amount of hydrated chromium oxides ranges from 3 to 25 $mg/m^2$ as expressed in elemental chromium.

* * * * *